US008443793B2

(12) United States Patent
Payen et al.

(10) Patent No.: US 8,443,793 B2
(45) Date of Patent: May 21, 2013

(54) HEATING APPARATUS

(75) Inventors: Vincent Payen, Hoboken, NJ (US); Michael Wadlinger, West Simsbury, CT (US); Joseph Mitchell, Somerset, NJ (US); Robert Finn, Westfield, NJ (US); George Carl Harmsen, Toms River, NJ (US); Dennis L. Myers, Newtown, PA (US)

(73) Assignee: Innophos, Inc., Cranbury, NJ (US)

( * ) Notice: Subject to any disclaimer, the term of this patent is extended or adjusted under 35 U.S.C. 154(b) by 949 days.

(21) Appl. No.: 11/098,066

(22) Filed: Apr. 4, 2005

(65) Prior Publication Data

US 2013/0047974 A1 Feb. 28, 2013

Related U.S. Application Data

(60) Provisional application No. 60/558,888, filed on Apr. 2, 2004.

(51) Int. Cl.
*F25D 5/00* (2006.01)

(52) U.S. Cl.
USPC ..... 126/263.01; 126/263.02; 126/263.03; 126/263.04; 126/263.05; 126/263.06; 44/251; 44/252; 44/253; 44/250; 426/109; 426/113; 426/114; 62/4; 62/530

(58) Field of Classification Search
USPC ..... 126/263.01, 263.02, 263.03, 263.04, 126/263.05, 263.06, 263.07, 263.08, 263.09, 126/263.1; 62/4, 530; 426/109, 113, 114; 44/251, 252, 253, 250; 465/46, 10; 252/70
See application file for complete search history.

(56) References Cited

U.S. PATENT DOCUMENTS

| | | | | | |
|---|---|---|---|---|---|
| 1,613,120 | A | * | 1/1927 | O'Neal et al. | 44/252 |
| 3,494,457 | A | * | 2/1970 | Titchenal | 206/484 |
| 3,615,712 | A | * | 10/1971 | Keller | 426/113 |
| 3,770,122 | A | * | 11/1973 | Thiele | 206/484 |
| 3,980,070 | A | * | 9/1976 | Krupa | 126/263.05 |
| 4,049,408 | A | * | 9/1977 | Patel | 62/4 |
| 4,067,313 | A | * | 1/1978 | Donnelly | 126/263.1 |
| 4,106,478 | A | | 8/1978 | Higashijima | |
| 4,264,362 | A | | 4/1981 | Sergev et al. | |
| 4,522,190 | A | | 6/1985 | Kuhn et al. | |
| 4,623,587 | A | * | 11/1986 | Ito et al. | 428/335 |
| 4,923,701 | A | * | 5/1990 | VanErden | 426/113 |
| 5,117,809 | A | * | 6/1992 | Scaringe et al. | 126/263.07 |
| 5,241,150 | A | * | 8/1993 | Garvey et al. | 219/725 |

(Continued)

OTHER PUBLICATIONS

International Search Report, Apr. 4, 2007.

*Primary Examiner* — Steven B McAllister
*Assistant Examiner* — Avinash Savani
(74) *Attorney, Agent, or Firm* — Joanne P. Will

(57) ABSTRACT

A heating apparatus includes an elongated flexible envelope (4) comprising two sheets (6), (8) that are attached to each other along permanent side seams (10), (12) and along a permanent bottom seam (14) and a moisture-activated chemical heater (16) disposed inside envelope (4), wherein envelope (4) is folded over on itself and secured by temporary side seams (18), (20) and a permanent top seam (22) to form a continuous moisture barrier surrounding the moisture activated chemical heater (16) and wherein heater (2) may be opened for use by removing top seam (22) and unfolding envelope (4) by unpeeling temporary seals (18), (20) to provide unfolded envelope (4), wherein sheets (6) and (8) remain sealed along permanent seams (10), (12) and (14), but wherein envelope (4) now has an open top end (30).

12 Claims, 6 Drawing Sheets

U.S. PATENT DOCUMENTS

| | | | | |
|---|---|---|---|---|
| 5,611,329 | A | 3/1997 | Lamensdorf | |
| 5,687,848 | A * | 11/1997 | Scholz et al. | 206/438 |
| 5,720,338 | A * | 2/1998 | Larson et al. | 165/46 |
| 5,823,683 | A * | 10/1998 | Antonacci et al. | 383/107 |
| 5,915,373 | A * | 6/1999 | Malover et al. | 126/263.02 |
| 5,935,486 | A | 8/1999 | Bell et al. | |
| 5,975,074 | A * | 11/1999 | Koiso et al. | 126/204 |
| 6,176,952 | B1 * | 1/2001 | Maugans et al. | 156/73.1 |
| 6,248,257 | B1 | 6/2001 | Bell et al. | |
| 6,289,889 | B1 | 9/2001 | Bell et al. | |
| 6,644,383 | B2 * | 11/2003 | Joseph et al. | 165/46 |
| 6,766,797 | B1 | 7/2004 | Lavigne et al. | |
| 6,929,400 | B2 * | 8/2005 | Razeti et al. | 383/66 |
| 6,943,229 | B2 * | 9/2005 | Funaki et al. | 526/351 |
| 7,488,789 | B2 * | 2/2009 | Ikenaga et al. | 526/348.6 |
| 2003/0223656 | A1 * | 12/2003 | Razeti et al. | 383/66 |

* cited by examiner

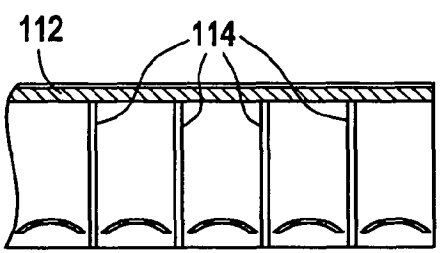
FIG. 9A
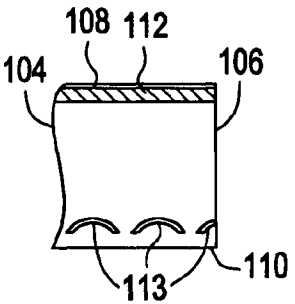
FIG. 9B
FIG. 9C
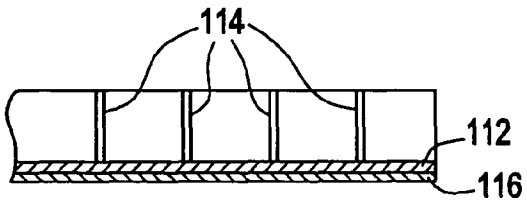
FIG. 9D
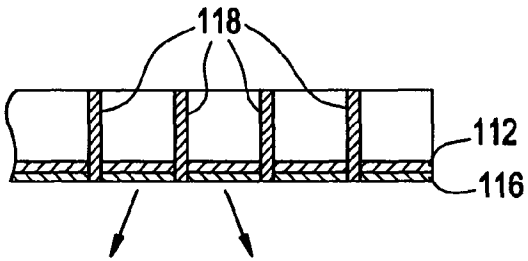
FIG. 9E
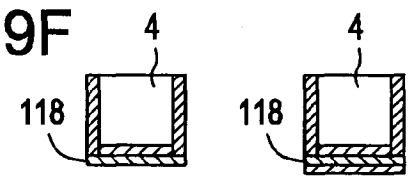
FIG. 9F

HEATING APPARATUS

CROSS-REFERENCE TO RELATED APPLICATIONS

This patent application also includes subject matter related to that disclosed in patent application: U.S. Provisional Patent Application Ser. No. 60/558,888, filed Apr. 2, 2004, entitled "HEATING APPARATUS". The foregoing patent application is assigned to the Assignee of the present invention and is hereby expressly incorporated by reference as part of the present disclosure.

FIELD OF THE INVENTION

This invention relates to a heating apparatus, more particularly to a heating apparatus that comprises a moisture resistant flexible package and a chemical heat source and that is suitable for various heating applications, such as for heating military field rations.

BACKGROUND OF THE INVENTION

U.S. Pat. Nos. 4,264,362, 4,522,190 and 5,611,329 describe embodiments of Flameless Ration Heaters (FRHs) of the type employed by the U.S. military to heat individual field rations (known as a "Meal Ready to Eat (MRE)). The heat source for such heaters is a mixture of an Mg—Fe alloy, NaCl, antifoaming agents and an inert filler. Upon exposure to water, the alloy under goes an exothermic reaction, that is, oxidation of the magnesium component of the alloy and generates heat.

The FRH is typically packaged in a sealed polyethylene envelope. In use the envelope is opened, a food retort pouch is inserted into the envelope and water is added to the envelope to contact the FRH for generating heat.

However, the oxidation of magnesium generates hydrogen gas, which may pose a safety hazard during storage and/or use of the FRH.

It would be useful to overcome the shortcomings of the prior art in order to provide a heating apparatus that provides a high heat output, in a controlled and reliable manner, that is resistant to environmental moisture and provides good storage stability and that does not generate a safety hazard during storage, shipping, use, or disposal and provides good storage stability and that does not generate a safety hazard during storage, shipping, use, or disposal.

SUMMARY OF THE INVENTION

In a first aspect, the present invention is directed to a moisture resistant flexible package, comprising an elongated flexible envelope (4) comprising two sheets (6), (8) that are attached to each other along permanent side seams (10), (12) and along a permanent bottom seam (14), wherein envelope (4) is folded over on itself and secured by temporary side seams (18), (20) and a temporary or a permanent top seam (22) to form a continuous moisture barrier surrounding the moisture activated chemical heater (16) and wherein heater (2) may be opened for use by opening or removing top seam (22) and unfolding envelope (4) by opening temporary side seams (18), (20) to provide unfolded envelope (4), wherein sheets (6) and (8) remain sealed along permanent seams (10), (12) and (14), but wherein envelope (4) now has an open top end (30).

In a second aspect, the present invention is directed to a heating apparatus, comprising:

an elongated flexible envelope (4) comprising two sheets (6), (8) that are attached to each other along permanent side seams (10), (12) and along a permanent bottom seam (14) and a moisture-activated chemical heater (16) disposed inside envelope (4), wherein envelope (4) is folded over on itself and secured by temporary side seams (18),(20) and a temporary or a permanent top seam (22) to form a continuous moisture barrier surrounding the moisture activated chemical heater (16) and wherein heater (2) may be opened for use by opening or removing top seam (22) and unfolding envelope (4) by opening temporary side seams (18), (20) to provide unfolded envelope (4), wherein sheets (6) and (8) remain sealed along permanent seams (10), (12) and (14), but wherein envelope (4) now has an open top end (30).

In a third aspect, the present invention is directed to a method of manufacturing a moisture resistant envelope. The method includes combining a first sheet and a second sheet of two continuous flexible sheets of one of similar or dissimilar materials of composition defining a continuous web; locating a continuous straight-line serrated pattern running parallel to a roll edge of the continuous first sheet; imparting the continuous straight-line serrated pattern while unwinding at least the continuous first sheet; creating a permanent bottom weld between the two continuous sheets forming a bottom permanent seal while an opposite open edge remains unsealed and open; creating opposing permanent welds along an entire length and perpendicular to the bottom weld forming opposing permanent side seals; folding the continuous web along its lateral center such that opposing edges substantially come together and each of the opposing permanent side seals are folded over on themselves; imparting a removable, peelable seal at an interface between the opposing permanent side seals are folded over on themselves; configuring a tear notch proximate the open edge and within a width of one of the opposing permanent seals and perpendicular to boundaries defining a seal width of the one of the opposing permanent side seals; and cutting along a length of each of the opposing permanent side seals and substantially in a middle thereof to delimit individual envelopes.

In one embodiment, the moisture activated chemical heater comprises a heat-producing agglomerate, comprising particles of an acidic component selected from acid anhydrides, acid salts, and mixtures thereof, or a basic component selected from bases, basic anhydrides, basic salts, and mixtures thereof, or a mixture of such acidic and basic components, and having an axial crush strength of greater than or equal to 0.5 kilopond.

BRIEF DESCRIPTION OF THE DRAWINGS

FIGS. 9(*a*)-9(*f*) show schematic views of a process for making an envelope (4).

DETAILED DESCRIPTION OF INVENTION AND PREFERRED EMBODIMENTS

Figure 1:
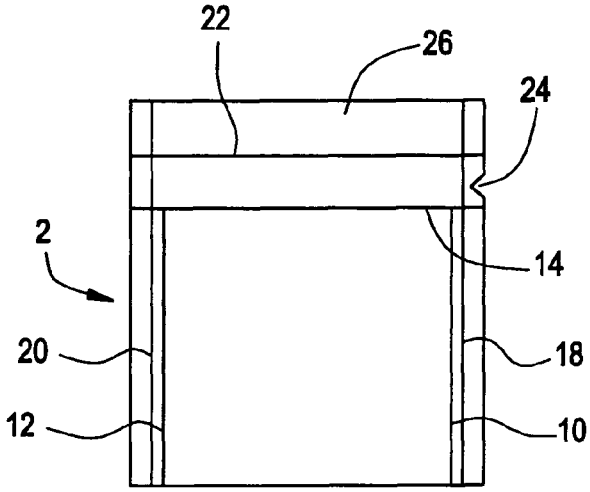
FIG. 1 shows a partially cut away front view of one embodiment of a heating apparatus (2) according to the present invention, in an unopened configuration.
Figure 2:
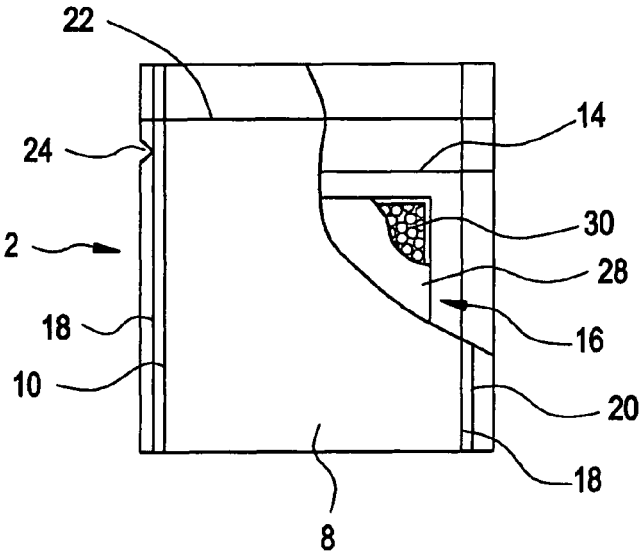
FIG. 2 shows a back view of the heating apparatus of FIG. 1, in an unopened configuration.
Figure 3:
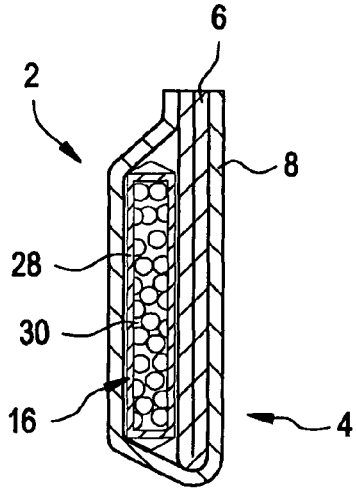
FIG. 3 shows a cross-sectional side elevation view of the heating apparatus of FIG. 1, in an unopened configuration.

Referring to FIGS. 1-3, a heating apparatus (2) comprises an elongated flexible envelope (4) including two sheets (6), (8) that are attached to each other along permanent opposing side seams (10), (12), and a permanent bottom seam (14) and containing a moisture-activated chemical heater (16) disposed inside envelope (4).

In the unopened position shown in FIGS. 1-3, the envelope (4) is folded over on itself and secured by temporary side seams (18), (20) and a top seam (22) to form a continuous moisture barrier surrounding the moisture activated chemical heater (16). Although shown as being offset for clarity in the Figures, temporary seams (18), (20) may and typically are superposed.

In one, embodiment, top seam (22) is a permanent seam and a tear notch (24) is provided on an edge of the heater (2) between seams 14 and 22 to define a tear strip (26) bearing permanent seal (22).

Alternatively, the top seam (22) may be a temporary seam and openable by, for example, unpeeling or unzipping the top seam (22).

The sheets (6), (8) comprise, for example, a monolayer or multiple layer flexible material, such as, for example, polymer film, metal foil, or a metallized or dielectric coated polymer film.

The envelope (4) of unopened heating apparatus (2) forms a continuous moisture barrier surrounding heater (16) to protect heater (16) from contact with ambient moisture and provide improved storage stability.

Heater (16) comprises a reactive material that is capable of undergoing an exothermic reaction, more typically a material that undergoes an exothermic reaction with water, and may further comprise a gas and liquid permeable container for the reactive material. Examples of suitable moisture activated heater compositions include those described in U.S. Pat. Nos. 5,935,486 and 6,248,257 B1. The reactive material may be in any convenient form, such as, for example, a powder, pellets, tablets, or agglomerates.

In one embodiment, the heater (16) is a packet comprising a water permeable envelope (28) and a particulate heater composition disposed within the water permeable envelope (28). In one embodiment, the water permeable envelop comprises a spunbonded, non-woven polyethylene terephthalate or polypropylene fabric.

In one embodiment, the heater (16) comprises a heat-producing agglomerate, comprising particles of an acidic component selected from acid anhydrides, acid salts, and mixtures thereof, or a basic component selected from bases, basic anhydrides, basic salts, and mixtures thereof, or a mixture of such acidic and basic components, and having an axial crush strength of greater than or equal to 0.5 kilopond.

As used herein, "agglomerate" means a cohesive mass of solid particulate material. Suitable agglomerates may be any convenient form, such as, for example, tablets, briquettes, tiles, pellets, beads, spheres, or granules. As used herein, "tablet" means a shaped mass of agglomerated particulate material that is similar in appearance to a pill oral dosage form typically used for medications, "briquette" and "tile" each refer to generally rectilinear masses of agglomerated particulate material which resemble, respectively, a brick or a tile, "pellet" refers to an elongated cylindrical mass of agglomerated particulate material, and "beads", "spheres" and "granules" each refer to generally spherical masses of agglomerated particulate material.

The acidic component and/or the basic component of the heat-producing agglomerate generate heat upon hydration, that is, upon contact with water. In those embodiments that comprise both an acidic component and a basic component, acidic and basic hydration products may further undergo an exothermic neutralization reaction and generate additional heat.

As used herein, "acidic salt" means a salt which, when dissolved in water, exhibits a pH of less than 7. Suitable acidic salts include, for example, aluminum chloride, zinc chloride, titanium tetrachloride, ferrous chloride, and ferric nitrate.

As used 'herein, "acidic anhydride" means a substance that is derived from an acid by removal of one or moles of water from the acid or that becomes an acid in the presence of water, and includes partially hydrated forms of such substances. Suitable acid anhydrides include, for example, phosphorus pentoxide, anhydrous aluminum chloride, partially hydrated acid anhydrides such as polyphosphoric acid, non-metal oxides such as B203 and BO, carboxylic acid anhydrides such as acetic anhydride, propionic anhydride, isobutyric anhydride, valeric anhydride, malonic anhydride, adipic anhydride, and phthalic anhydride.

In one embodiment, the acidic component of the agglomerate of the present invention comprises phosphorus pentoxide.

As used herein, "base" means a substance which, when dissolved in water, exhibits a pH of greater than 7. Suitable bases include, for example, calcium hydroxide, potassium hydroxide.

As used herein, "basic salt" means a salt which, when dissolved in water, exhibits a pH of greater than 7. Suitable basic salts include, for example, sodium acetate, sodium benzoate, and potassium ascorbate.

As used herein, "basic anhydride" means a substance that is derived from a base by removal of one or moles of water from the base or that becomes a base in the presence of water, and includes partially hydrated forms of such substances. Suitable basic anhydrides include, for example, calcium oxide, metal oxides such as lithium oxide, sodium oxide, potassium oxide, rubidium oxide, cesium oxide, magnesium oxide, strontium oxide, and barium oxide.

In one embodiment, the basic component of the agglomerate of the present invention comprises calcium oxide, calcium hydroxide or a mixture thereof. In one embodiment, the basic component of the present invention is calcium oxide. In another embodiment, the basic component is a mixture, comprising, based on 100 pbw of the mixture, from about 35 to about 99 pbw, more typically from about from about 40 to about 95 pbw, calcium oxide and from about from about 1 to about 65 pbw, more typically from about 5 to about 60 pbw, calcium hydroxide.

The relative amounts of acid component, basic component and any other components of the heat-producing agglomerate are selected to provide a desired heat output per unit mass of agglomerate. The relative amounts may also be selected to provide a residue, that is, material remaining after use of the agglomerate, having desired properties, such as, for example, to provide a residue having a pH in a desired range.

In one embodiment, the agglomerate of the present invention comprises, based on 100 parts by weight of the acid component and basic component of the agglomerate, from 0 to about 100 pbw, more typically from about 25 to about 85 pbw, even more typically from about 40 to about 75 pbw, and still more typically from about 50 to about 65 pbw, of the acidic component and from about 0 to about 100 pbw, more typically from about 15 to about 75 pbw, even more typically from about 25 to about 60 pbw, and still more typically from about 35 to about 50 pbw of the basic component.

In one embodiment, the agglomerate of the present invention comprises a mixture of particles of an acidic component selected from acid anhydrides, acid salts, and mixtures thereof and a, basic component selected from bases, basic anhydrides, basic salts, and mixtures thereof.

In one embodiment, the acidic component of the present invention comprises phosphorus pentoxide and the basic component of the present invention comprises calcium oxide, calcium hydroxide or a mixture thereof. In another embodiment, the acidic component of the present invention is phosphorus pentoxide and the basic component of the present invention is calcium oxide.

The use of particulate acidic and basic components having certain 5 selected particle size distributions appears to provide improved control over the reaction kinetics of the heat-producing agglomerate of the present invention and thus the rate of heat generation exhibited by the agglomerate. Typical particle sizes for particles of the acidic component of the composition of the present invention are given below as percent by volume ("vol %") of the total amount of such particles, as determined by laser diffraction. Typical particle sizes for particles of the basic component of the composition of the present invention are given below as percent by weight ("wt %") of the total amount of such particles, as determined by sieve analysis.

In one embodiment, the particles of the acidic component exhibit a particle size distribution wherein:

less than about 10 vol %, more typically less than about 5 vol %, of the particles have a particle size of greater than about 180 μm, and less than about 10 vol % of the particles has a particle size of less 20 than about 15 μm.

In one embodiment, the acidic component of the present invention is phosphorus pentoxide having a particle size distribution wherein:

less than about 10 vol %, more typically less than about 5 vol %, of 25 the particles have a particle size of greater than about 180 μm, from about 80 vol % to about 100 vol % of the particles have a particle size of from about 15 μm to about 180 μm, more typically from about 20 pm, to about 140 pm, and even more typically from about 25 μm to about 100 pm, and less than about 10 vol % of the particles has a particle size of less than about 15 μm.

In one embodiment, the particles of the basic component exhibit a particle size distribution wherein less than or equal to about 10 wt %, more typically about 5 wt %, of the particles have a particle size of greater than about 850 μm and less than or equal to about 50 wt %, more typically greater than or equal to about 40 wt %, of the particles have a particle size of greater than about 212 μm.

In one embodiment, the basic component of the present invention is calcium oxide having a particle size distribution wherein greater than or equal to about 40 wt % of the calcium oxide particles have a particle size of less than about 212 μm.

In another embodiment, the basic component of the present invention is calcium oxide having a particle size distribution wherein less than or equal to about 10 wt %, more typically less than or equal to about 5 wt %, of the calcium oxide particles have a particle size of greater than about 1180 μm. and less than or equal to about 40 wt %, more typically less than or equal to about 35 wt %, of the calcium oxide particle have a particle size of less than about 212 μm.

The heat-producing agglomerate may include other components, such as, for example, lubricants, flow aids, binders, disintegrants, solubilizers, and surfactants. In one embodiment, the heat-producing agglomerate of the present invention comprises, based on 100 pbw of the agglomerate, from about 80 to about 99 pbw, more typically from about 85 to about 98 pbw, of the acid component, basic component, or mixture thereof and from about 1 to about 20 pbw, more typically from about 2 to about 15 pbw, of other components.

In one embodiment, the heat producing agglomerate further comprises a lubricant. As used herein, "lubricant" means a substance that reduces friction between the composition of the present invention and the surfaces of the apparatus used to compact the composition into a compressed form. Suitable lubricants include, for example, stearic acid or mixtures of fatty acids, hydrogenated vegetable oils, triglycerides of fatty acids, metal stearates, such as for example, zinc stearate and magnesium stearate, or metal salts of fatty acid mixtures, sodium lauryl sulfate, polyethylene glycol and talc, as well as mixtures thereof. In one embodiment, the lubricant component of the composition of the present invention comprises magnesium stearate.

In one embodiment, the heat-producing agglomerate comprises, based on 100 pbw of agglomerate, from about 0.1 to about 5 pbw, more typically from about 0.5 to about 3 pbw, and still more typically from about 1 to about 2 pbw, of a lubricant.

In one embodiment, the heat producing agglomerate of the present invention further comprises a flow aid. It is desirable that the mixture of particulate components be and remain free-flowing prior until such time as the mixture is compacted to form an agglomerate. A free flowing mixture is more easily transferred and more readily fills, for example, the mold cavities of a tablet press than would a mixture that is more prone to agglomeration. As used herein, "flow aid" means a substance that discourages agglomeration of the mixture of particulate components prior to compaction to thereby maintain the flowability of the mixture. Suitable flow aids include, for example, silica, talc, and tricalcium phosphate. In one embodiment, the flow aid component of the composition of the present invention comprises a precipitated silica, a fumed silica, or a mixture thereof.

In one embodiment, the heat-producing agglomerate comprises, 5 based on 100 pbw of the agglomerate, from about 0.1 to about 5, more typically from about 0.2 to about 2, and still more typically from about 0.3 to about 1 pbw, of a flow aid.

The heat-producing agglomerate may further comprise other 10 components, such as for example, binders, disintegrants, solubilizers and surfactants. Typically, such other components are added in order to adjust the rate at which the heat-producing agglomerate of the present invention generates heat when the agglomerate is exposed to water.

As used herein, "binder" means any substance that is capable of rendering the mixture of acidic component and basic component of the composition of the present invention compactable into a solid, coherent mass. Suitable binder compounds include, for example, waxes, polyvinylpyrrolidones, and hydroxyalkyl cellulose derivatives such as hydroxypropyl methylcellulose, hydroxypropyl cellulose and hydroxyethyl cellulose, as well as mixtures of the above.

In one embodiment, the binder is a hydrophobic binder that also serves to introduce hydrophobic domains into the agglomerate structure. Suitable hydrophobic binders include waxes such as, for example, paraffin, carnuba wax, and microcrystalline waxes. In one embodiment, the binder component comprises carnuba wax.

In one embodiment, the heat-producing agglomerate comprises, based on 100 pbw of the agglomerate, from about 0.5 to about 10, more typically from about 3 to about 7 pbw, of a binder.

In one embodiment, the agglomerate comprises:

from about 40 to about 60 pbw of an acidic component, from about 30 to about 50 pbw of a basic component, from about 0.5 to about 10 pbw of an binder, from about 0.1 to about 5 pbw of lubricant, from about 0.1 to about 5 pbw of a fluidizing agent.

As used herein, "disintegrant" means a substance that is substantially insoluble in water, but that is capable of swelling in water. Disintegrants serve to accelerate the disintegration and dissolution in an aqueous medium of compressed forms of the composition of the present invention. Suitable disintegrants include, for example, sodium carboxylmethyl starch, microcrystalline cellulose, soy protein, alginic acid, cross linked polyvinylpyrrolidone, also known as cross linked povidone, and cross linked sodium carboxymethylcellulose, also known as croscarmellose sodium, as well as mixtures thereof. In one embodiment, the disintegrant of the composition of the present invention comprises croscarmellose sodium.

In one embodiment, the heat-producing agglomerate comprises, based on 100 pbw of the agglomerate, from about 1 to about 8, more typically from about 2 to about 5 pbw, of a disintegrant.

As used 'herein, "solubilizer" means a water soluble component that increases the rate at which a compressed form of the composition of the present invention dissolves in water. Suitable solubilizers include, for example, polysaccharides such as maltodextrin, sorbitol, and lactose.

In one embodiment, the heat-producing agglomerate, based on 100 pbw of the agglomerate, from about 1 to about 5 pbw of a solubilizer.

Suitable surfactants include, nonionic surfactants, such as polyalkoxylated alcohols, cationic surfactants, such as imidazolines, dialkyl quaternary compounds, alkoxylated fatty amines, aliphatic, aromatic fatty amines, aliphatic fatty amides, and quarternary ammonium derivatives, anionic surfactants such as salts of alkyl benzene sulfonates, alkyl sulfates, alkyl ether sulfates, alkaryl ether sulfates, dialkyl sulfosuccinates polyalkoxylated alcohol sulfates, and ether phosphates, and amphoteric surfactants such as alkali salts of amphocarboxyglycinates and amphocarboxypropionates, alkyl amphodipropionates, alkyl amphodiacetates, and alkyl amphopropyl sulfonates.

In one embodiment, the heat-producing agglomerate comprises, based on 100 pbw of the agglomerate, from about 0.5 to about 5 pbw of a surfactant.

In one embodiment, the agglomerate is a particulate agglomerate having a mass of greater than 0.05 grams ("g") per agglomerate particle, more typically from about 0.05 about 2 g per agglomerate particle, even more typically from about 0.1 to about 1 g per agglomerate particle, and still more typically from about 0.3 to about 0.6 g per agglomerate particle.

In one embodiment, the heat-producing agglomerate is in the form of a tablet, more typically, the heat-producing in the form of a tablet that is roughly the shape of a right circular cylinder having a diameter of from about 0.1 inch to about 1 inch, more typically from about 0.25 inch to about 0.6 inch, and a height of from about 0.01 inch to about 0.5 inch, more typically from about 0.0625 inch to about 0.25 inch.

In another embodiment, the heat-producing agglomerate is in the form of briquettes or tiles.

In another embodiment, the heat-producing agglomerate is in the form of pellets.

In another embodiment, the heat-producing agglomerate is in the form of or beads, spheres or granules.

Crush strength, as referred to herein, is measured according to ASTM D4179-88a, wherein the force required to crush agglomerates between two steel anvils is measured. In one embodiment, the heat-producing composition of the present invention exhibits an axial crush strength of greater than or equal to 0.5 kilopond ("kp"), more typically, from about 1 to about 10 kp, even more typically from about 2 to about 8 kp, and still more typically from about 3 to about 8 kp.

Friability, as referred to herein, is measured according to US Pharmacopia 1216 Tablet Friability test (USP 25) and expressed as an attrition rate. The heat-producing agglomerates of the present invention exhibit an attrition rate of less than 8%, more typically less than about 4%. Even more typically, the agglomerate of the present invention is substantially non-friable and exhibits an attrition rate of less than 3%.

The heat-producing agglomerates may be made by any agglomeration technique, including agitation agglomeration techniques, such as fluidized bed drying and high shear mixing, pressure agglomeration techniques, such as compression, spray agglomeration techniques, such as spray drying, and thermal agglomeration techniques, such as sintering.

In one embodiment, the heat-producing agglomerate is made by 5 compressing a particulate heat-producing composition at a compressive force of from about 0.1 ton to about 1.5 tons, more typically from about 0.5 ton to about 1.0 ton.

In one embodiment, the compressive force is applied in a tablet press 10 to produce an agglomerate in the form of tablets.

In another embodiment, the compressive force is applied in a two-roll mill to produce sticks or sheets of compressed heat-producing composition that are then briquetted or granulated to produce agglomerates of a desired size.

The heat-producing agglomerate is used by exposing the agglomerate to water.

In one embodiment, the heat-producing agglomerate is contacted with greater than 30 grams (g) water, more typically from about 60 g to about 100 g water, per 100 grams of agglomerate.

In one embodiment, the heat-producing agglomerate exhibits a total 25 heat output, as measured in a closed adiabatic calorimeter of greater than 120 kilojoules (kJ) per 100 grams of agglomerate, more typically from about 140 to about 240 per 100 grams of agglomerate, and even more typically from about 160 to about 200 per 100 grams of agglomerate.

In one embodiment, the heat-producing agglomerate exhibits a rate of heat output, as determined by measuring heat output as a function of reaction time, of greater than about 15 to about 15,000 Watts ("W") per 100 grams of agglomerate, more typically from about 200 to about 4000 W per 100 grams of agglomerate, and a cumulative heat output of greater than about 120 kJ per 100 grams of agglomerate, more typically greater than about 140 kJ per 100 grams of agglomerate, is generated within about 5 minutes of exposure of the agglomerate to water.

In one embodiment, the outer sheet (8) is imprinted with information regarding heater characteristic and with instructions regarding opening of the heater. In an exemplary embodiment, inner sheet (6) is printed with alpha, numeric, or graphic instructions regarding opening of the heater.

Figure 4A:
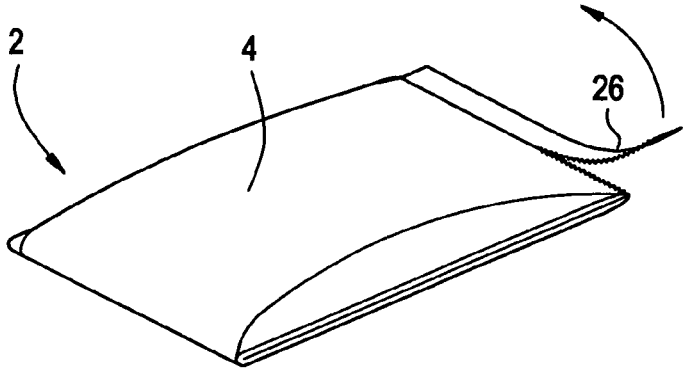
FIGS. 4(*a*)-4(*c*) illustrate opening the heating apparatus shown in FIGS. 1-3.
Figure 4B:
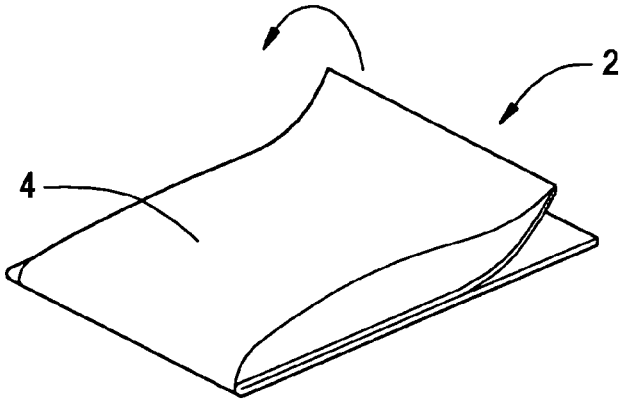
Figure 4C:
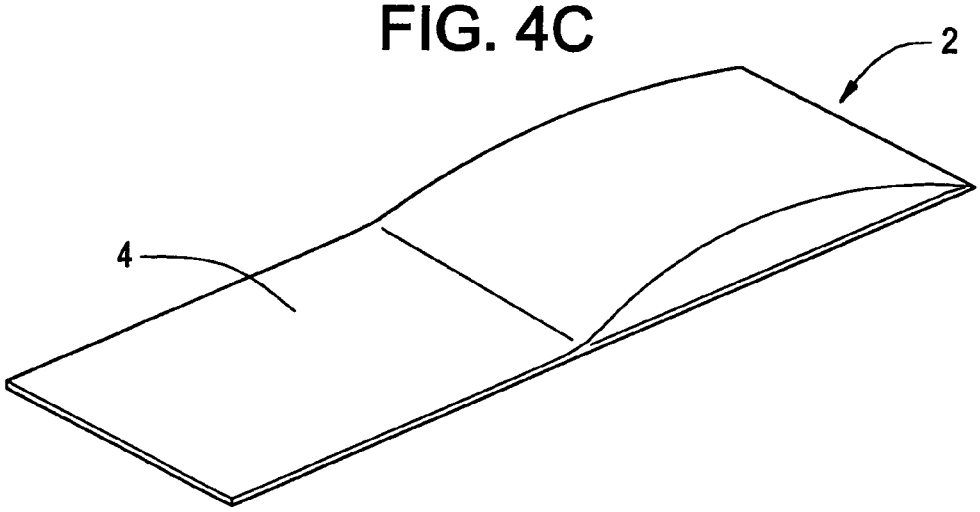

Referring to FIGS. 4(*a*)-4(*c*), the heater (2) is opened by ripping the heater (2) at notch (24) and tearing tear strip (26) off of the heating apparatus (2) and then unfolding envelope (4) by unpeeling temporary seals (18), (20).

Figure 5:
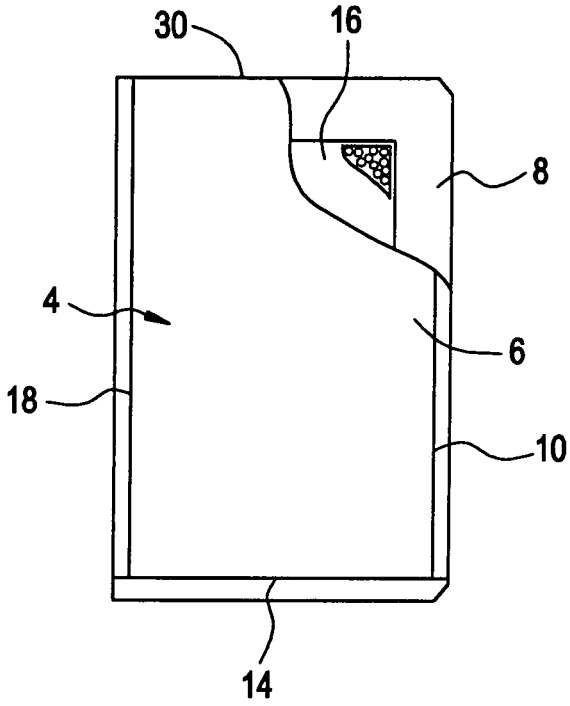
FIG. 5 shows a partially cut away front view of the heating apparatus of FIGS. 1-3, in an opened configuration.
Figure 6:
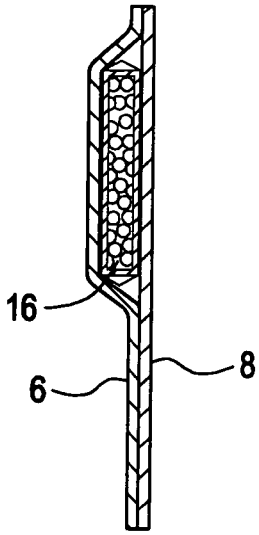
FIG. 6 shows a cross-sectional side elevation view of the heating apparatus of FIGS. 1-3, in an opened configuration.
Figure 7A:
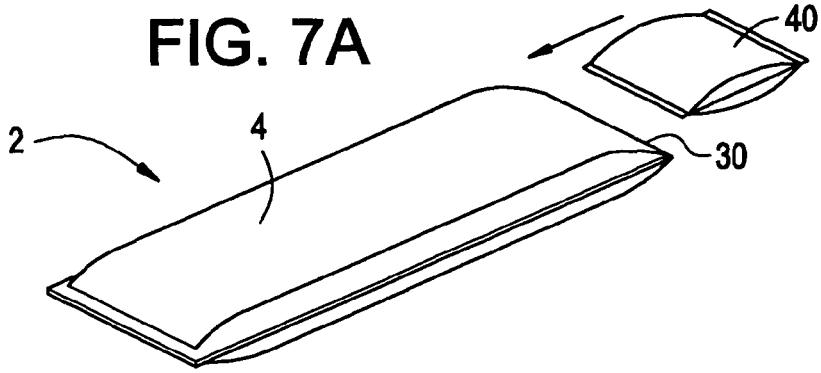
FIGS. 7(*a*)-7(*e*) illustrate use of the heating apparatus shown in FIGS. 1-3.
Figure 7B:
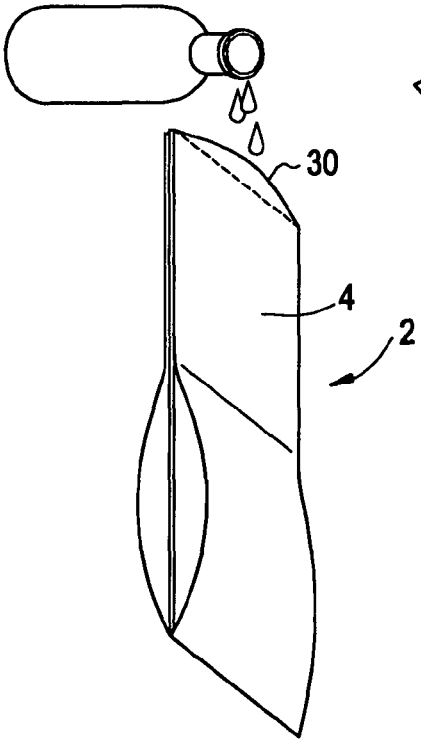
Figure 7C:
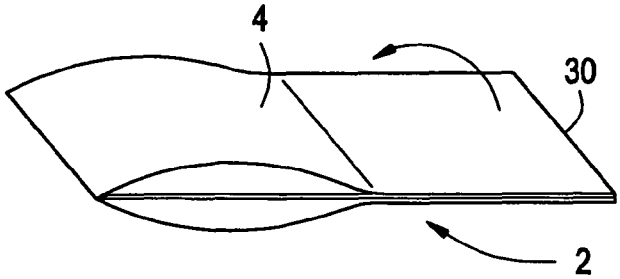
Figure 7D:
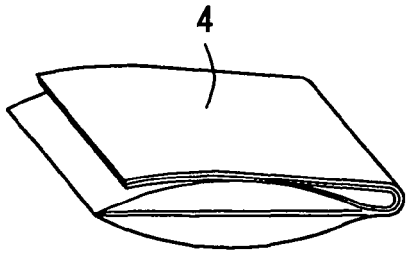
Figure 7E:
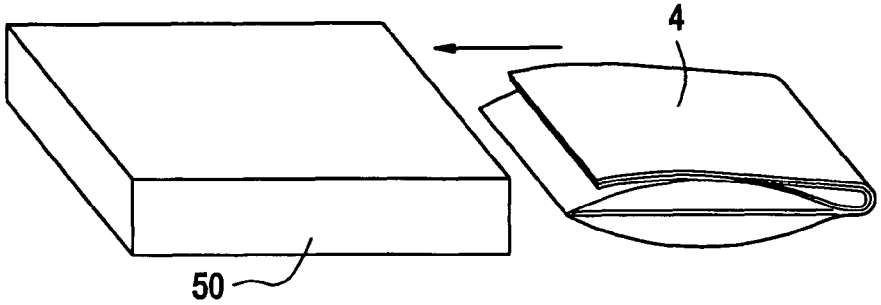

Referring to FIGS. 5 and 6, the opened heating apparatus (2) includes unfolded envelope (4), wherein sheets (6) and (8) remain sealed along permanent seams (10), (12) and (14), but wherein envelope (4) now has an open top end (30). Heater packet (16) remains disposed within envelope (4). In one embodiment, the inner sheet (6) is printed with instructions regarding proper operation of the heating apparatus (2). In one embodiment, the inner sheet (6) is sufficiently transparent or translucent to allow a user to view the contents of the envelope (4) and is imprinted with instructions regarding proper operation of the heating apparatus. (2) and with an indication of the proper water fill level.

Referring to FIG. 7(*a*), heating apparatus (2) is used by inserting a 30 object to be heated (40) into envelope (4) through open top end (30) of envelope (4). The object to be heated (40) is used to push heater (16) into the bottom portion of envelope (4), that is, toward permanent seam (14), so that the heater (16) and object to be heated are each disposed in contact with each other and in the bottom portion of envelope (4).

Referring to FIG. 7(*b*), water is then introduced into envelope (4) through open top end (30). In one embodiment, the inner sheet (6) is a translucent or transparent material, so that the contents of envelope (4) are visible through the sheet (6), and the inner sheet (6) is marked with indicia that indicate the proper water fill level to activate the heater (16).

Figure 8:
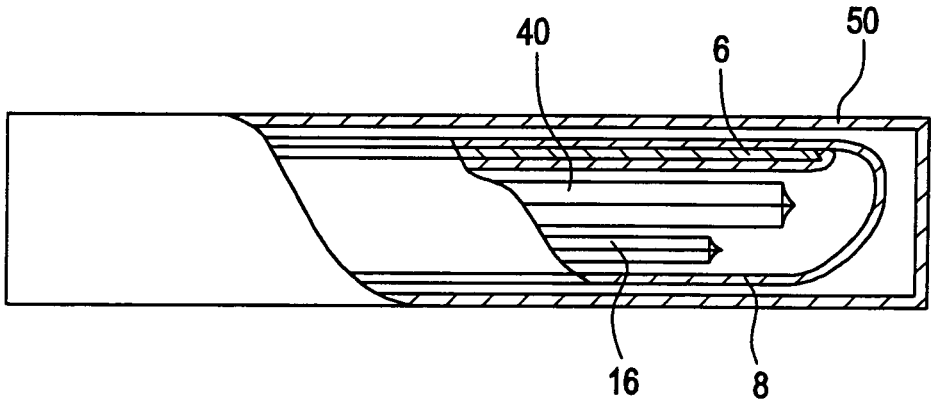
FIG. 8 shows a cross-sectional side elevation view of the heating apparatus of FIGS. 1-3, in an operational position for heating an object.

Referring to FIGS. 7(*c*)-7(*e*) and FIG. 8, envelope 4 is then folded over on itself and folded over envelope (4) containing heater (16), water and the object to be heated (40) is inserted into an insulating sleeve (50). The heat generated by reaction of water with heater (16) is then used to heat the object to be heated (40).

The envelope (4) is constructed of materials that are substantially impervious to water, and does not react with the components of the heat-producing agglomerate under the conditions of use. In an exemplary embodiment, envelope (4) is made with sheets (6) and (8) that are polymerically compatible at their respective sealing interfaces and are attached to each other along fused, permanent seams (10), (12) and (14). Envelope (4) is folded over on itself and secured by temporary, peelable side seams (18) and (20) and a temporary or permanent top seam (22). Envelope (4) may be opened for use by opening and removing top seam (22) and unfolding envelope (4) by opening temporary side seams (18), (20) to provide unfolded envelope (4), wherein sheets (6) and (8) remain sealed along permanent seams (10), (12) and (14).

Indeed, the material of the outer and inner sheets (6) and (8) should be compatible and chosen in such a way so that upon heat application, the two materials will fuse with each other at the molecular level. If there is no fusion but only interfacial sealing, then the strength of the seal may not be enough to resist when the peelable seals placed on the top of them are opened. In an exemplary embodiment the outer and inner sheets (6) and (8) are chosen from compatible material, so that upon heat application, a fusion at the molecular level takes place between the sheets, so as to allow an opening of the peelable seals without breaking the integrity of the permanent seals below.

In one embodiment, outer sheet (8) is made of a material that exhibits very low moisture vapor transmission, for example, less than or equal to about 0.05 grams moisture per 100 square inches material per day. In an exemplary embodiment, one or more materials exhibit less than or equal to about 0.05 grams of water moisture per 100 square inches material per 24 hours or per day, when tested under ASTM E-96 with test conditions at about 100° F. and 90% relative humidity. Suitable materials for outer sheet (8) include sheets comprising polychlorotrifluoroethylenes (PCTFE), liquid crystal polymers (LCP), cyclic olefin copolymers (COC), vacuum deposited metallized and dielectric coated polymers, nanocomposite, polymer encapsulated aluminum foils or combinations of same. The nanocomposite includes nanoclay containing polymers.

In one embodiment, outer sheet (8) is a laminate comprising a core sheet of a metal, typically an aluminum foil bonded on one side to a biaxially oriented polymer film comprising, for example, a polyester, polypropylene, or polyamide polymer and on the opposite side to a thermoplastic, substantially amorphous polymer film, comprising, for example, a polyethylene, polypropylene, polyethylene terephthalate, or polyethylene isophthalate polymer or copolymer of all.

In another embodiment, one layer of the encapsulating aluminum foil core may include a thermoplastic having substantially at least one of an amorphous coating or film from coextruded multiple layers containing at least one layer of a polypropylene polymer or copolymer.

In one embodiment, inner sheet (6) is a polymer film or coating. Suitable polymer or copolymer materials include, for example, thermoplastic, substantially amorphous polymer films (monolayer or coextruded inclusive) or coatings or combinations of same, comprising, for example polyethylene, polyethylene terephthalate, polyethylene isophthalate, or polypropylene polymer or copolymer of all or a nanocomposite. The nanocomposite includes a nanoclay containing polymer.

In one embodiment, sheet (6) is a polypropylene copolymer sheet. In one embodiment, sheet (6) is a SUPROP® polypropylene film (Tufpak, Inc. Ossipee, N.H.), which is a rapidly water-quenched film that exhibits a lower crystallinity than conventional polypropylene films.

In one embodiment, permanent seams (10), (12), (14), and (22) are areas where sheet (6) is permanently fused to sheet (8). Typically, the fused seams are formed by contacting the areas of sheets (6) and (8) to be sealed together in a heat sealing device using, for example, heated bars, heated rolls, a continuous band heater, pressurized hot air, electronically controlled impulse heater bands to compress and heat the areas to be sealed wherein the pressure, temperature, and the heating time is sufficient to fuse the polymers of sheets (6), (8).

In one embodiment, the temporary seams (18), (20) are areas where inner sheets (6) are removably adhered to itself. In one embodiment, the temporary seams are formed by contacting the areas of sheet (6) to be sealed together in a heat sealing device using, for example, heated bars, heated rolls, a continuous band heater, pressurized hot air, electronically controlled impulse heater band to compress and heat the areas to be sealed, wherein the pressure, temperature, and the heating time is sufficient to removably adhere sheet (6) to itself, but not permanently fuse sheet (6) to itself. Sealing at a temperature of from about 360 to 395° F., a seal head pressure of from about 40 to about 85 pounds per square inch, and a dwell time of from about 0.4 to about 0.85 seconds have been found to be suitable process conditions for the removably adhering SUPROP® polypropylene film to itself to form temporary seams that can later be manually unpeeled without ripping the film. Alternatively, temporary seams (18), (20) may be formed using an adhesive or by forming a selectively resealable structure, such as for example, interlocking coextruded ribs, to removably adhere sheet 6 to itself in the area of such seals.

Referring to FIGS. 9(*a*)-9(*f*), the envelope (4) is formed generally by:

stacking a section of a first film (100), comprising material suitable for inner sheet (6), on a section of second film (102), comprising material suitable for outer sheet (8), wherein the stacked sections extend longitudinally from a first end (104) to a second end (106), and extend axially from a top edge (108) to a bottom edge (110), heat sealing the first film (100) to the second film (102) near the top edges (108) of the stacked sections to form a longitudinally extending permanent seam (112) near the top edges (108) of the stacked sections, heat sealing the first film to the second film to form a series of pairs (114) of parallel, longitudinally spaced apart, axially extending permanent seams, wherein the paired seams of the series are longitudinally spaced apart along the stacked sections, folding the top edges (108) of the stacked sections over to meet the bottom edges (110) of the stacked sections, heat sealing the folded stacked sections to form a series of axially extending temporary seams (118), each of which is superimposed over a respective pair of axially extending permanent seams (114), cutting tear notches (120) at each axially extending temporary seam (118), between the longitudinally extending permanent seams (112), (116), and cutting the folded, stacked films between the seams of each pair of parallel, longitudinally paced apart, axially extending permanent seams (114) to form envelopes (4).

In one embodiment, the object to be heated (40) is a sealed package of food, such as, for example a food retort pouch used as a military food ration.

Referring again to FIGS. 9(*a*)-9(*f*), a manufacturing process for a moisture resistant envelope (4), comprised of two continuous flexible sheets of either similar or dissimilar materials of composition, can be combined and converted as described below and in accordance with another embodiment. While unwinding the continuous moving first film or top sheet (100), a continuous straight-line serrated pattern (103) is imparted proximate inside of edge (108). The location of this straight-line serration is between roll edge (108) and permanent seal (112). The straight-line serration runs parallel to both roll edge (108) and permanent seal (112). This feature provides functional importance when opening the finished, filled, sealed envelope as it allows controlled tearing, to maintain the containment integrity of the bottom of the envelope. Next a permanent weld is created by fusing two continuous sheets (100) and (102) in a precise location (e.g., parallel with web edge (108)), thus defining envelope bottom seal (112). Fusing can include heat sealing that is controlled under pressure, however, any thermal method is envisioned suitable to the desired end purpose. In an exemplary embodiment, fusing is maintained under non-stop continuously moving conditions, holding registered web edges (108) and location of bottom seal (112) constant, while opposite web edge (110) remains unsealed and open.

A serrated pattern (113) is punched, under registered and intermittent control, into continuous moving sheet along web edge (110) on top sheet (100). Serrated pattern (113) is imparted for function so that when each envelope (4) is torn open, the serrated pattern will tear away and be effectively detached from a finished envelope prior to use, allowing easier openability of peelable seals during opening. In an exemplary embodiment serrated pattern (113) is cut in a "V" or chevron like shape within the boundaries of yet to be applied permanent weld seals (114), so as to facilitate an easier opening of envelope (4)

The continuous web as described above, then moves into a heat sealing location in which additional permanent weld seals (114) are imparted under controlled pressure and heat. Seals (114) are imparted perpendicular to the aforementioned permanent seal (112), covering an entire web width from previously sealed envelope edge (108) to open edge (110).

The continuous web is then folded along a lateral centerline, machine directional axis, so that edges (108) and (110) come together exactly or slightly offset from one another. Additionally, the permanent seals (114) are folded over on themselves substantially as in a mirror image.

The folded web then continues to move into a next transverse sealing section of the machine which imparts the removable, peelable seal (118) under tightly controlled manufacturing conditions for pressure, temperature and dwell time (all of which change and are variable based upon substrate selection and machine speed). Temporary, peelable seal strengths measured under controlled conditions will have demonstrable and quantified values between 45 grams and 2270 grams per lineal inch.

The continuous web then accepts either a tear cut or tear notch (24) outside or above seal (112), proximate web edge (116) and within the width of seal (118). Tear cut or notch (24) is punched within, and perpendicular to, the boundaries of seal width (118).

The continuous web then moves next to a converting equipment section, which effectively cuts in the middle of seal (118). The cuts in the middle of seal (118) create either individual, equal sized envelopes (4) or serrated/perforated cuts in the middle of seal (118). The serrated/perforated cuts in the continuous web material in a pattern in the middle of seal (118) allow individual envelopes (4) to be wound continuously on a roll to facilitate individual envelope separation at a later time from the wound roll.

In one embodiment, envelopes (4) may then be loaded with the moisture activated chemical heater pouch via open envelope edge (116). Envelope (4) is then fused permanently (e.g., heat-sealed) between locations of tear notch (24) as described above and envelope edge (116). This seal preferably runs parallel with envelope edge (116). The width of this final heat seal should be sufficient in width to maintain the protective integrity of the contents of envelope (4).

In an alternative embodiment, envelope (4) may then be loaded with the moisture activated chemical heater pouch via open edge (116). Envelope (4) is then closed with a temporary removable, releasable seal, perhaps with either a straight shape or a chevron style shape to facilitate ease of peelability during opening. In this embodiment, the above described steps associated with imparting serrated patterns and incorporating a tear cut or notch (24) may be eliminated. The width and degree of peelability of this final heat seal should be sufficient in width and strength to maintain the protective integrity of the contents of envelope (4).

What is claimed is:

1. A moisture resistant flexible package for a moisture-activated chemical heater, comprising:

an outer sheet;

an inner sheet consisting of a rapidly quenched, low crystallinity polypropylene, wherein the inner sheet is substantially superposed and attached to the outer sheet along three contiguous sides thereof forming permanent opposing side seams and a permanent bottom seam intermediate the permanent opposing side seams thus defining an elongated flexible envelope having an open top end opposite the permanent bottom seam, a fold defined by folding the envelope over on itself; and temporary side seams formed by heat sealing the polypropylene inner sheet to itself; and a removable top seam intermediate the temporary side seams securing the envelope in a folded position to form a continuous moisture barrier surrounding a moisture activated chemical heater disposed in the envelope;

wherein the heater can be opened for use by opening or removing the top seam and unfolding the envelope by opening the temporary side seams to provide the unfolded envelope, the outer and inner sheets remaining sealed along the permanent side seams and permanent bottom seam while allowing access inside the envelope via the open top end.

2. The moisture resistant flexible package of claim 1, wherein the outer and inner sheets exhibit less than or equal to about 0.05 grams of water moisture per 100 square inches material per 24 hours per day, when tested under ASTM E-96 with test conditions at about 100° F. and 90% relative humidity.

3. The moisture resistant flexible package of claim 1, wherein the outer sheet is made of one of:

a polychlorotrifluoroethylene (PCTFE);

a liquid crystal polymer (LCP);

a cyclic olefin copolymer (COC);

a vacuum deposited metallized polymer;

a vacuum deposited dielectric coated polymer;

a nanocomposite; and a polymer encapsulated aluminum foil core.

4. The moisture resistant flexible package of claim 3, wherein the nanocomposite includes a nanoclay containing polymer.

5. The moisture resistant flexible package of claim 3, wherein one layer of the encapsulating aluminum foil core includes:

a biaxially oriented polyester film;

a biaxially oriented polyamide film;

a biaxially oriented polypropylene film; and a thermoplastic having substantially at least one of an amorphous coating and film from one of a polypropylene polymer group, a polyethylene polymer group, a polyethylene terephthalate polymer group, and a isophthalate polymer group.

6. The moisture resistant flexible package of claim 3, wherein one layer encapsulating aluminum foil core includes a thermoplastic having substantially at least one of an amorphous coating and film from coextruded multiple layers containing at least one layer of a polypropylene polymer.

7. The moisture resistant flexible package of claim 1, wherein the inner sheet is printed with one of alpha, numeric, and graphic instructions.

8. A heating apparatus, comprising:

an outer sheet;

an inner sheet consisting of a rapidly quenched, low crystallinity polypropylene, wherein the inner sheet is substantially superposed and attached to the first sheet along three contiguous sides thereof forming permanent opposing side seams and a permanent bottom seam intermediate the permanent opposing side seams thus defining an elongated flexible envelope having an open top end opposite the permanent bottom seam;

a moisture-activated chemical heater disposed inside the envelope;

a fold defined by folding the envelope over on itself and secured by temporary side seams formed by heat sealing the polypropylene inner sheet to itself; and a removable top seam intermediate the temporary side seams to form a continuous moisture barrier surrounding the moisture activated chemical heater;

wherein access to the moisture activated chemical heater for use includes removing the top seam and unfolding the envelope about the fold by opening the temporary seals to provide the unfolded envelope, the outer and inner sheets remaining sealed along the permanent seams with access inside the envelope being allowed via the open top end.

9. The heater of claim 8, wherein the moisture activated chemical heater comprises:

a heat-producing agglomerate, the heat-producing agglomerate comprising:

one of particles of an acidic component selected from acid anhydrides, acid salts, and mixtures thereof, or particles of a basic component selected from bases, basic anhydrides, basic salts, and mixtures thereof, or a mixture of the acidic and basic components.

10. The heater of claim 9, wherein the heat-producing agglomerate has an axial crush strength of greater than or equal to 0.5 kilopond.

11. The moisture resistant flexible package of claim 1, wherein the temporary side seams are formed by heat sealing the polypropylene inner sheet to itself at a temperature of from 360° F. to 395° F., a seal head pressure of from 40 to 85 pounds per square inch, and a dwell time of 0.4 to 0.85 seconds.

12. The heating apparatus claim 8, wherein the temporary side seams are formed by heat sealing the polypropylene inner sheet to itself at a temperature of from 360° F. to 395° F., a seal head pressure of from 40 to 85 pounds per square inch, and a dwell time of 0.4 to 0.85 seconds.

* * * * *